US007434701B1

(12) United States Patent
Freeman et al.

(10) Patent No.: US 7,434,701 B1
(45) Date of Patent: Oct. 14, 2008

(54) DEVICE FOR COUPLING TO OTHER DEVICES AND UNIQUE IDENTIFICATION THEREOF

(75) Inventors: Rich Freeman, San Carlos, CA (US); John Caldwell, San Jose, CA (US); David Wilson, Los Altos, CA (US); Robert Mitchell, Redwood City, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 0 days.

(21) Appl. No.: 10/966,300

(22) Filed: Oct. 15, 2004

(51) Int. Cl.
*A63H 19/18* (2006.01)

(52) U.S. Cl. ..... 213/75 TC

(58) Field of Classification Search ..... 213/75 R, 213/76, 77, 75 TC, 75 D, 1.3, 1.6
See application file for complete search history.

(56) References Cited

U.S. PATENT DOCUMENTS

| | | | | |
|---|---|---|---|---|
| 5,455,465 | A * | 10/1995 | House | 307/69 |
| 5,775,525 | A * | 7/1998 | Brill | 213/75 TC |
| 6,276,542 | B1 * | 8/2001 | McCrary | 213/75 R |
| 2004/0144742 | A1 * | 7/2004 | Buchwald et al. | 213/75 R |

* cited by examiner

*Primary Examiner*—Mark Le
*Assistant Examiner*—Robert J McCarry, Jr.

(57) ABSTRACT

A device for coupling to other devices and unique identification thereof may include a body and a coupler. The coupler may be disposed on the body and may be operable to couple to a coupler of another device. The device may include a test circuit and a processor for recognizing other devices. The processor may be operable to determine the presence of a particular device within a chain of devices by controlling the inputs of the test circuit and monitoring the outputs of the test circuit. The device may include a circuit element for uniquely identifying the device when the device is coupled to one or more of the other devices.

26 Claims, 9 Drawing Sheets

DEVICE FOR COUPLING TO OTHER DEVICES AND UNIQUE IDENTIFICATION THEREOF

BACKGROUND OF THE INVENTION

Coupling of devices may involve electrically and/or mechanically coupling of a plurality of devices. In some applications, there may also be a need to uniquely identify each of the coupled devices. For example, a toy may include a plurality of units (e.g., train cars) operable to be coupled and uncoupled by a user.

SUMMARY OF THE INVENTION

Accordingly, there is a need for coupling a plurality of devices and unique identification of each of the coupled devices. What is needed is a coupler adapted for providing an electrical and mechanical coupling of the devices. The coupler may need to provide flexible coupling between the devices. The coupler may also need to enable coupling and uncoupling with relatively little coordination. The coupler and a circuit may also need to enable determination of the presence of a particular device in response to the device being coupled to another device.

Embodiments of the present invention are directed toward a device for coupling to other devices and unique identification thereof. In one embodiment, a device for coupling to other devices includes a body, a plurality of couplers and a circuit element. A first coupler may be disposed on a first side of the body and a second coupler may be disposed on a second side of the body. The couplers may be operable to electrically couple to couplers of the other devices. The circuit element may provide for unique identification of the device when the device is coupled to one or more of the other devices. In one embodiment the devices are mechanically coupled in a chain fashion.

In another embodiment, a device for recognizing other devices coupled in the chain includes a body, a coupler, a test circuit and a processor. The coupler may be disposed on the body and may be operable to couple to a coupler of another device. The processor may be operable to determine presence of a particular device within a chain of devices by controlling the inputs of the test circuit and monitoring the outputs of the test circuit.

In one embodiment, each coupler may include a plurality of terminals and a magnet. The plurality of terminals provide for electrical coupling and the magnet provides for mechanical coupling between the devices in a chain. When coupled in a chain fashion, the couplers allow electronic circuits within each coupled device to be electrically connected together. In one embodiment, they are electrically coupled in parallel together.

BRIEF DESCRIPTION OF THE DRAWINGS

Embodiments of the present invention are illustrated by way of example and not by way of limitation, in the figures of the accompanying drawings and in which like reference numerals refer to similar elements and in which.

DETAILED DESCRIPTION OF THE INVENTION

Reference will now be made in detail to the embodiments of the invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the scope of the invention as defined by the appended claims. Furthermore, in the following detailed description of the present invention, numerous specific details are set forth in order to provide a thorough understanding of the present invention. However, it is understood that the present invention may be practiced without these specific details. In other instances, well-known methods, procedures, components, and circuits have not been described in detail as not to unnecessarily obscure aspects of the present invention.

Figure 1:
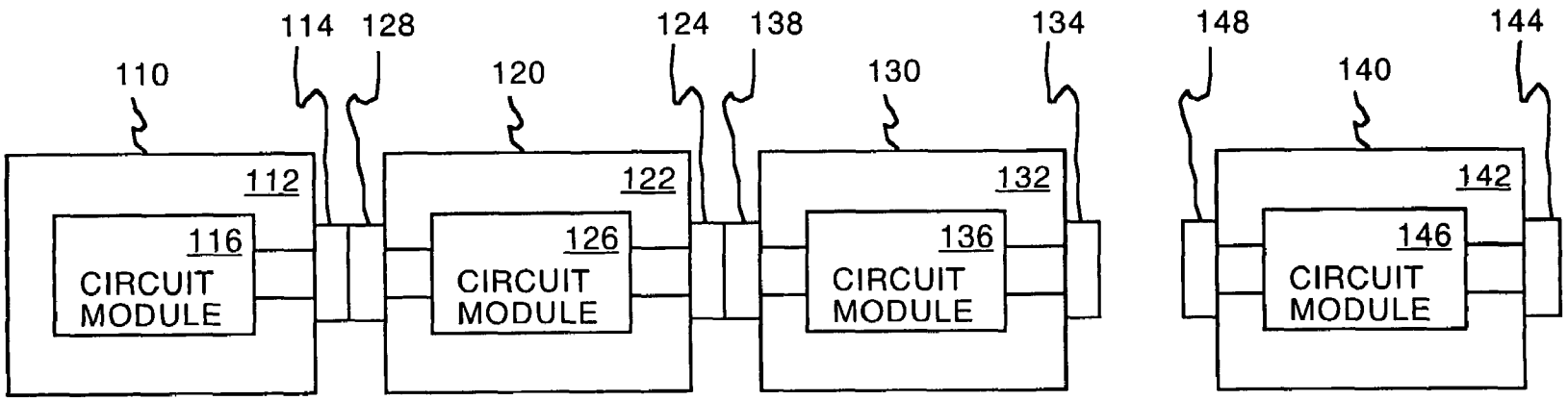
FIG. 1 shows a block diagram of a plurality of devices for coupling to other devices, in accordance with embodiments of the present invention.

Referring to FIG. 1, a block diagram of a plurality of devices for coupling to other devices, in accordance with embodiments of the present invention, is shown. As depicted in FIG. 1, each device 120 may be coupled to other like devices 110, 120, 130 in a chain. Each device 120 includes a body 122, one or more couplers 124, 128 and a circuit module 126. The couplers 124, 128 and circuit module 126 may be disposed on or in the body 122. The couplers 124, 128 are operable to electrically couple the circuit module 126 of a respective device 120 to the circuit modules 116, 136, 146 of other devices 110, 130, 140 that are coupled within the chain. The couplers 124, 128 may also be operable to mechanically couple the respective device 120 to the other devices 110, 130, 140. The mechanical coupling may be provided by a captive coupling (e.g., ball and hitch, bolt and receiver, post and hole, etc.), a frictional coupling (e.g., clasp, clamp, etc.), magnetic coupling or the like. In one embodiment, the mechanical coupling is releasable.

In one embodiment, the head-end or control device 110 includes a body 112, a coupler 114, and a circuit module 116. The coupler 114 may be disposed on a side (e.g., back end) of the body 112. The coupler 114 may be operable to electrically couple the circuit module 116 of the device 110 to a circuit module 126 of another device 120. In one implementation, the circuit module 116 includes a processor and a test circuit. The test circuit includes one or more inputs and outputs and may be electrically coupled to the coupler 114 and the processor. The processor may be operable to determine the presence of a particular device within a chain of coupled devices 120, 130 by controlling one or more inputs of the test circuit and monitoring one or more outputs of the test circuit. In one implementation, the presence of one or more particular devices may be determined by measuring a characteristic, such as impedance, resistance, capacitance, time constant, inductance, direction of conduction, or the like, of the resultant electrical circuit including the circuit element of each device coupled therewith. In another implementation, the presence of a particular device may be determined by measuring the difference in values of circuit elements of the same kind, such as a first resistance value, a second resistance value and so on. An exemplary test circuit is described in more detail below.

Figure 2:
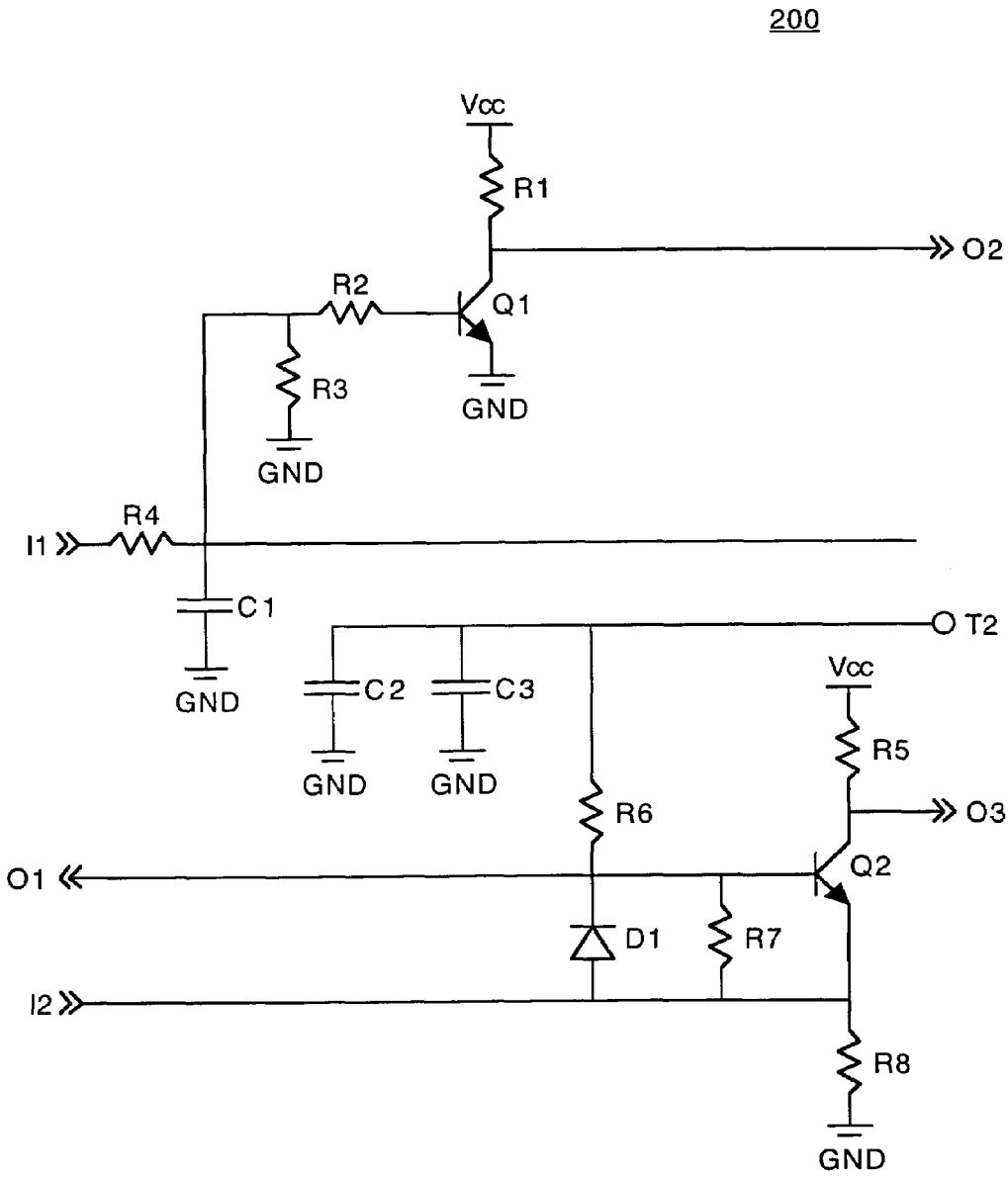
FIG. 2 shows a block diagram of an exemplary test circuit, in accordance with embodiments of the present invention.

Referring now to FIG. 2, a block diagram of an exemplary test circuit 200, in accordance with embodiments of the present invention, is shown. As depicted in FIG. 2, a plurality of inputs I1, I2, a plurality of terminals T1, T2, a plurality of outputs O1, O2, O3, a plurality of resistors R1-R8, a plurality of capacitors C1-C3, a plurality of transistors Q1, Q2, a diode D1, a supply voltage Vcc and a ground GND are interconnect to form the exemplary test circuit 200. The terminals T1, T2 are operable to be electrically coupled to respective terminals of the circuit module of another device. Inputs signals may be received from a processor on the first and/or second inputs I1, I2. One or more output signals may be generated as a function of the input signals and one or more circuit modules of other devices coupled to the terminals T1, T2. The output signals may be measured by the processor on the first, second and/or third outputs O1, O2, O3. Operation of the exemplary test circuit is described in more detail below.

Referring again to FIG. 1, in another embodiment, the device 130 includes a body 132, a first coupler 134, a second coupler 138 and a circuit module 136. The first coupler 134 is disposed on a first side (e.g., front end) of the body 132 and the second coupler 138 is disposed on a second side (e.g., back end) of the body 132. The first coupler 134 and second coupler 138 may be operable to electrically couple the circuit module 136 of the device 130 to circuit modules 126, 146 of one or more other devices 120, 140. In one implementation, the circuit module 136 includes one or more circuit elements including passive components, such as one or more resistors, capacitors, diodes or the like. In one embodiment, only passive elements are employed. The circuit element(s) may be operable to uniquely identify a particular device. The circuit element(s) in each device provide electrical continuity between a first and second terminal of each coupler.

Figure 3A:
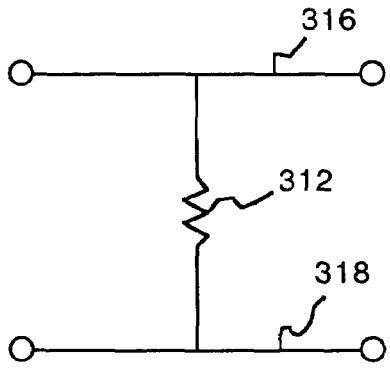
FIGS. 3A, 3B, 3C, 3D and 3E show block diagrams of exemplary circuit modules, in accordance with embodiments of the present invention.
Figure 3B:
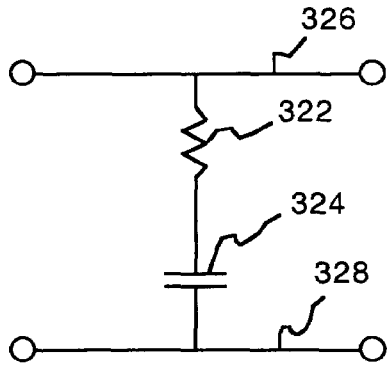
Figure 3C:
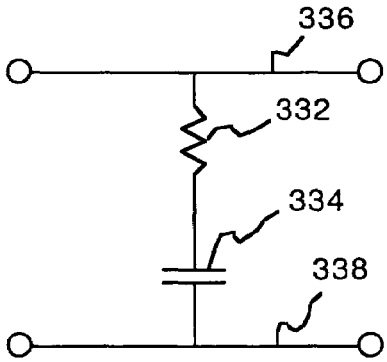
Figure 3D:
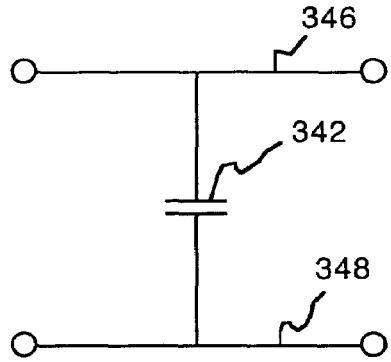
Figure 3E:
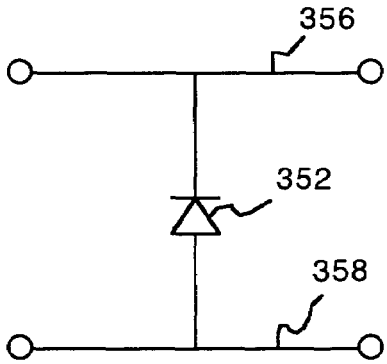

Referring now to FIGS. 3A, 3B, 3C, 3D and 3E, block diagrams of exemplary circuit modules, in accordance with embodiments of the present invention, are shown. Each circuit module may be disposed in a respective device to uniquely identify the particular device once connected to the chain under test. Each circuit module may include one or more passive circuit components. As depicted in FIG. 3A, a first circuit module may include a resistor 312 coupled between a first and second set of terminals 316, 318. The first circuit module may be characterized by a resistance that uniquely identifies the particular device containing the first circuit module. As depicted in FIG. 3B, a second circuit module may include a resistor 322 and capacitor 324 coupled in series between a first and second set of terminals 326, 328. The second circuit module may be characterized by a first time constant that uniquely identifies the particular device containing the second circuit module. As depicted in FIG. 3C, a third circuit module may include a resistor 332 and capacitor 334 coupled in series between a first and second set of terminals 336, 338. The third circuit module may be characterized by a second time constant that uniquely identifies the particular device containing the third circuit module. As depicted in FIG. 3D, a fourth circuit module may include a capacitor 342 coupled between a first and second set of terminals 346, 348. The fourth circuit module may be characterized by a capacitance that uniquely identifies the particular device containing the fourth circuit module. As depicted in FIG. 3E, a fifth circuit module may include a diode 352 coupled between a first and second set of terminals 256, 358. The fifth circuit module may be characterized by a direction of conduction that uniquely identifies the particular device containing the fifth circuit module. Operation of the exemplary circuit modules are described in more detail below.

Figure 4:
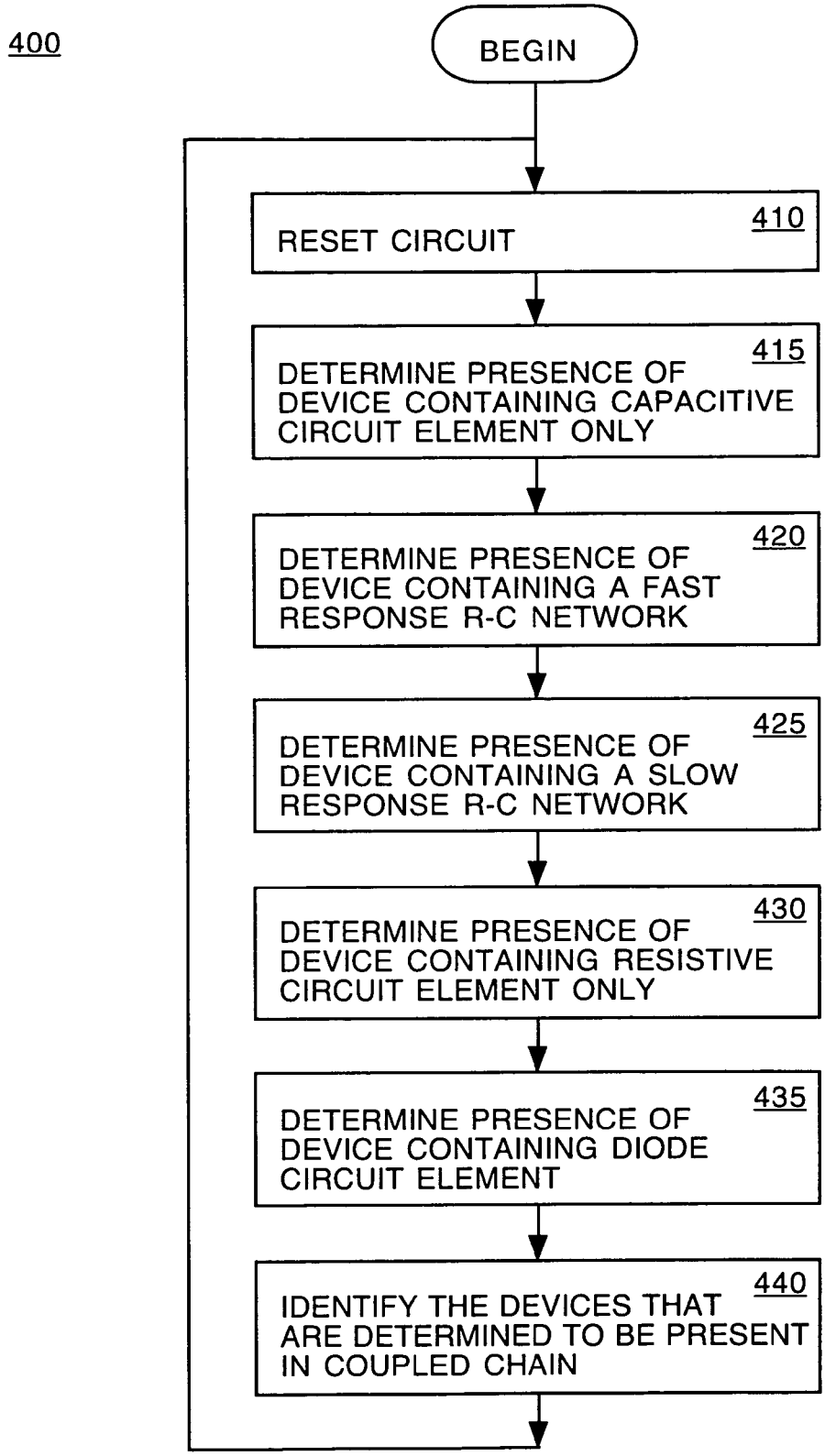
FIG. 4 shows a flow diagram of an exemplary electronic method of determining the presence of a particular device within a chain of devices, in accordance with embodiments of the present invention.

Referring now to FIG. 4, a flow diagram of an exemplary electronic method of determining the presence of a particular device within a chain of devices, in accordance with one embodiment of the present invention, is shown. As depicted in FIG. 4, the exemplary method 400 includes repetitively testing for each of a plurality of devices, wherein each device contains a different circuit module. It is appreciated that one or more circuit modules (e.g., FIGS. 3A-3E) present within a coupled chain of devices may be electrically coupled in parallel. Test circuit 200 under program control 400 is able to apply tests to this resultant circuit to determine the presence of individual circuit modules coupled therein. In one embodiment, the head-end or control device 110 performs this function with respect to the chain of coupled devices that is coupled to it. A chain may include a single device coupled to the head-end or control device 110.

At 410, the circuit module containing the test circuit may be periodically reset. In one implementation, the test circuit 200 of FIG. 2 may be reset by driving the inputs I1 and I2 active low to discharge all capacitors. The reset time may be reduced by driving the output O1 active low. The reset state may be maintained for a first period of time.

At step 415, the presence of a circuit module containing only a capacitive element may be determined. In one implementation, the first input I1 may be driven active high and the second input I2 may be driven active low, after the test circuit 200 has been reset. After a second time period the state of the second output O2 may be determined. If the second output O2 is high, a device containing only a capacitive element is present. If the second output O2 is low, a device containing only a capacitive element is not present. More specifically, if a device containing only a capacitive element is not present, the first input I1 via resistor R12 of the test circuit 200 can easily drive the second output O2 low in less than the second time period. If and only if a device containing a capacitive element is present, will the first input I1 of the test circuit not be able to drive the second output O2 low until after the expiration of the second time period owing to the very low impedance of the capacitor short circuit to ground via C6 and C10. It is appreciated that all other circuit modules have a significant series resistance, and the first input I1 can readily drive the second output O2 of the test circuit 200 low within the second time period.

At step 420, the presence of a device containing a fast response R-C network (e.g., short time constant) may be determined by charging the network for a short amount of time and then measuring the results. In one implementation the presence of a device having a short time constant may be determined by driving the inputs I1 and I2 to a high impedance state after a third time interval, as measured from when the first input I1 is driven active high and the second input I2 is driven active low at step 415. The state of the second output may be read after a fourth time interval, as measured from when the first and second inputs I1, I2 are driven to a high impedance state. If the second output is low, a device containing an R-C network having a short time constant is present. It is appreciated that a circuit module that can store energy but has a longer time constant, will not build up enough energy during the third time period to affect the state of the second output O2. However, to reliably determine the presence of a circuit module having a slow response R-C network, the test for determining the presence of a fast response R-C network should be performed first. It is also appreciated that a circuit module having only a capacitance will not have enough energy from its small capacitor to sustain the state of the second output O2 for the full fourth time period.

At step 425, the presence of a device containing a slow response R-C network (e.g., long time constant) may be determined by charging the network for a longer amount of time and then measuring the results. In one implementation the presence of a device having a long time constant element may be determined by driving the first input I1 active high and the second input I2 active low for a fifth time period, such that the network is effectively "charge soaked." The first and second inputs I1, I2 may be driven to a high impedance state after the fifth time interval. The state of the second output O2 may be monitored. If the second output goes high after a predetermined sixth period of time, as measured from the end of the fifth period of time, than a device containing an R-C network having a long time constant is present.

At step 430, the presence of a device containing a resistive element providing a direct current path may be determined. In one implementation, the presence of a resistive element may be determined by driving the first input I1 active high and the second input I2 active low. The third output may be monitored for a seventh period of time. If the third output O3 is low after the seventh period of time, than a resistive element is present. If the third output O3 is high after the seventh period of time, than the resistive element is not present. It is appreciated that the other circuit elements can drive the third output O3 low temporarily until their series capacitors are charge. Only the direct current path provided by the resistive element can sustain the third output O3 at a low state.

At step 435, the presence of a device containing a diode element providing a unidirectional conduction (e.g., current) path may be determined by a reverse current test. In one implementation, the presence of a diode element may be determined by driving the first input I1 active high and the second input I2 active high. The state of the second output O2 may be determined after an eighth time period, as measured from when the first input I1 is driven active high and the second input I2 is driven active high. If the second output is low after the eighth time period, than a device containing a diode element is present. It is appreciated that devices containing a resistive element or slow response R-C network have too high of an impedance to drive the second output O2 low. It is also appreciated that devices containing a capacitive element or a fast response R-C network may only hold the second output O2 low for a short period of time.

At step 440, the devices that are determined to be present in the chain of coupled devices are identified. In one implementation, a signal identifying each particular device in the chain of devices is generated. The signal may, for example, drive a speaker operable to render an audible identifier of the device determined to be present. The audible identifier may describe a feature of each particular device present. For example, the color of the device, a character, number, symbol or the like on the device, a feature of the device or a tune associated with the device may be output.

It is appreciated that the exemplary method may be implemented in hardware, software, firmware and any combination thereof. It is also appreciated that the steps of the exemplary method may be modified to be performed in any desired order.

Referring again to FIG. 1, in one embodiment, each coupler may include two or more electrical terminals. The electrical terminals of a given device may be operable to make electrical connections with respective electrical terminals of another device. The electrical connections may be utilized to transmit electro-magnetic energy and/or electro-magnetic signals.

Referring now to FIGS. 5, 6, 7, 8A, 8B, 9 and 10, diagrams of couplers, in accordance with embodiments of the present invention, are shown. As depicted in FIGS. 5, 6, 7, 8A, 8B, 9 and 10, each coupler includes one or more magnets and a plurality of terminals. A magnetic force produced by the magnet may cause the coupler to mechanically couple releasably to a magnetic or metallic entity. Each of the plurality of terminals of the coupler may provide an electrical coupling to other terminals when brought into contact with each other by the mechanical coupling provided by the magnet. The electrical coupling may be utilized to transmit electro-magnetic energy and/or electro-magnetic signals.

Figure 5:
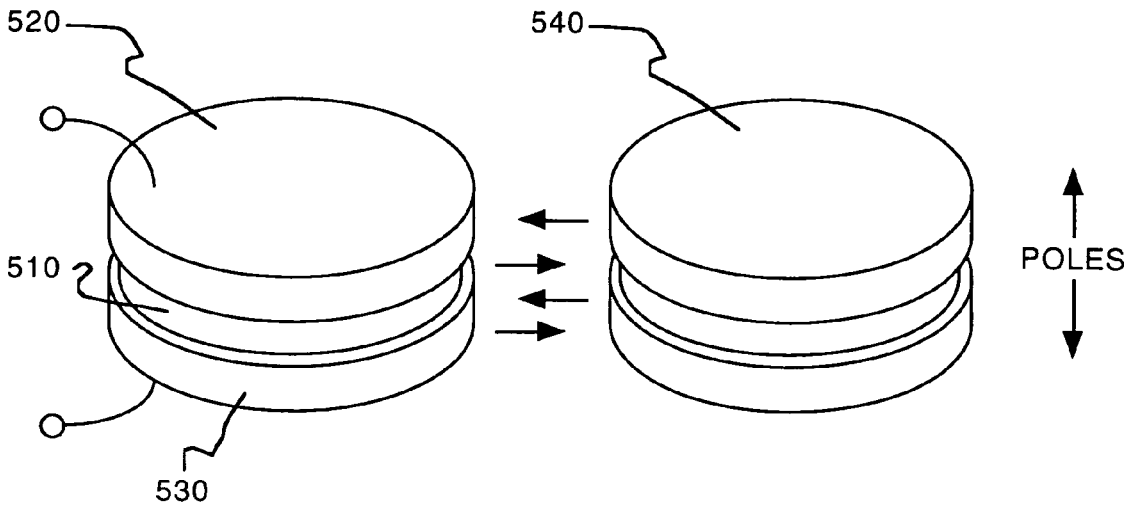
FIG. 5 shows a block diagram of a coupler, in accordance with one embodiment of the present invention.

In one embodiment, as depicted in FIG. 5, each coupler includes a magnet 510, a first terminal 520 disposed proximate a first portion of the magnet 510 and a second terminal 530 disposed proximate a second portion of the magnet 510. The magnetic fields generated by the magnets mechanically couple the couplers when brought in proximity to each other. The corresponding terminals 520, 540 of two couplers electrically couple to each other when brought in contact with each other by the mechanical coupling provided by the magnet 510.

Figure 9:
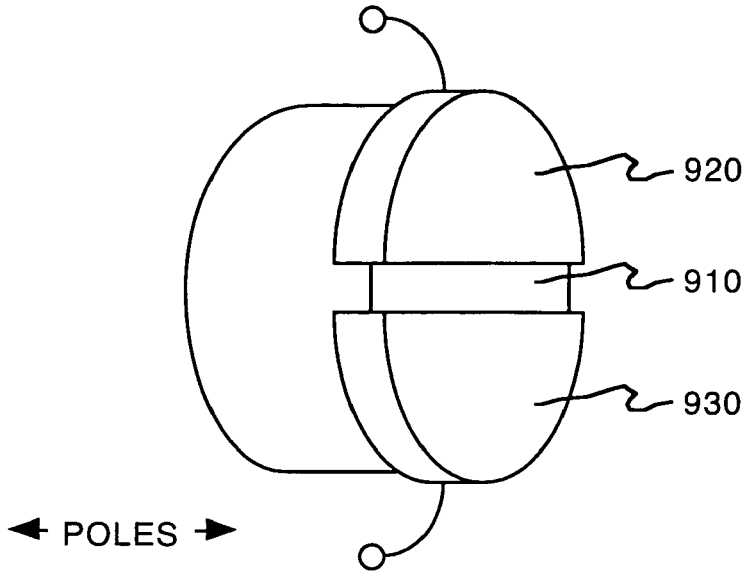
FIG. 9 shows a block diagram of a coupler, in accordance with another embodiment of the present invention.
Figure 10:
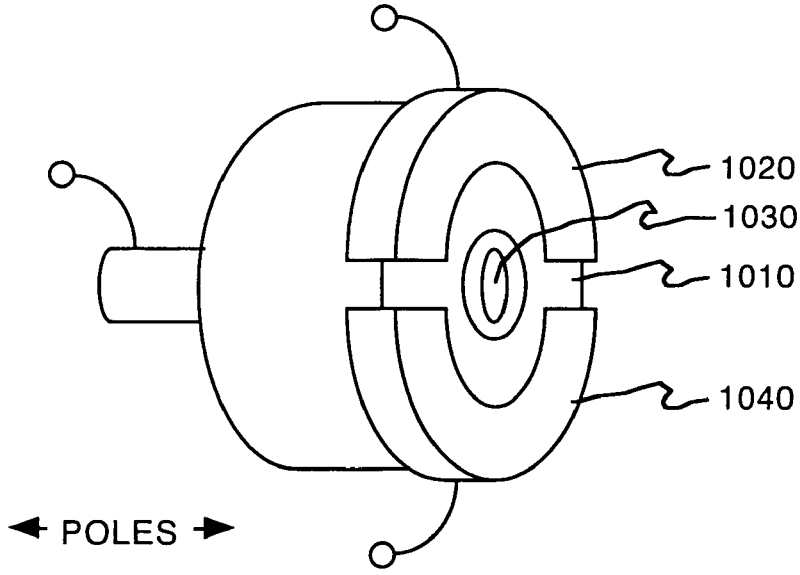
FIG. 10 shows a block diagram of a coupler, in accordance with another embodiment of the present invention.

In one embodiment, as depicted in FIG. 5, 6, 7, 8A and 8B, the couplers may be mechanically coupled along a substantially arched surface of at least one of the couplers. The arched surface operates to provide a pivotal mechanical coupling. In another embodiment, as depicted in FIGS. 9 and 10, the couplers may be mechanically coupled along a substantially flat surface of at least one of the couplers. The flat surface operates to provide a relatively greater mechanical coupling as compared to an arched surface.

Figure 6:
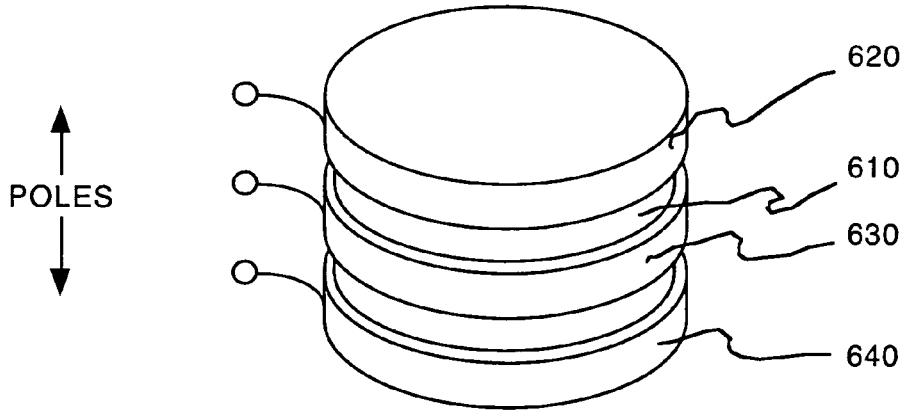
FIG. 6 shows a block diagram of a coupler, in accordance with another embodiment of the present invention.

In one embodiment, as depicted in FIGS. 5 and 6, the terminals 520, 530, 620, 630, 640 and magnets 510, 610 may be disposed such that the mechanical coupling may be established axially to the poles (e.g., along the sides) of the magnets 510, 610. In another embodiment, as depicted in FIGS. 9 and 10, the terminals 920, 930, 1020, 1030, 1040 and magnets 910, 1010 may be disposed such that the mechanical coupling may be established proximate a pole (e.g., end) of the magnets 910, 1010.

In one embodiment, as depicted in FIGS. 6 and 10, the couplers may include a magnet 610, 1010 and three terminals 620, 630, 640, 1020, 1030, 1040. A first terminal 620, 1020 may be disposed proximate a first portion of the magnet 610, 1010 and a second terminal 640, 1040 may be disposed proximate a second portion of the magnet 610, 1010. A third terminal 630, 1030 may be disposed proximate a third portion of the magnet 610, 1010 between the first and second terminals 620, 640, 1020, 1040. In one embodiment, the first and second terminals 620, 640, 1020, 1040 may be caps and the third terminal 630, 1030 may be a circular band, a semicircular band (not shown) or the like. In another embodiment, the third terminal 630, 1030 may be a pin, rod or the like. It is also appreciated that embodiments having three or more terminals may be implemented utilizing a plurality of magnets.

For example, in one embodiment, the first and second terminals may be caps disposed on opposite ends of respective pair of magnets and the third terminal may be a disk sandwiched between the magnets.

It is appreciated that one or more terminals may be resiliently biased (e.g., spring) outwardly from the surface where coupling may be established. The resiliently biased terminals may be adapted to improve the electrical coupling between coupled terminals.

Figure 7:
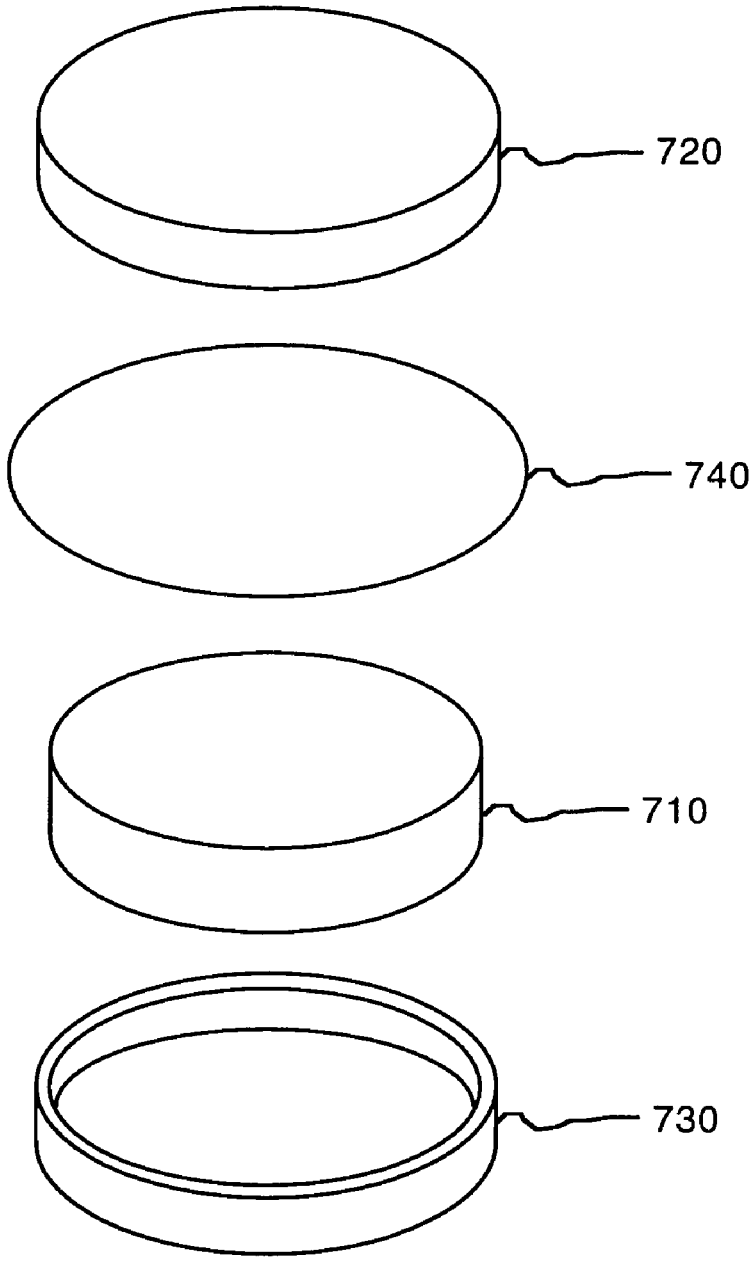
FIG. 7 shows a block diagram of a coupler, in accordance with another embodiment of the present invention.

Referring now to FIG. 7, a block diagram of an exploded view of a coupler, in accordance with one embodiment of the present invention, is shown. As depicted in FIG. 7, the coupler includes a magnet 710, a first terminal 720 and second terminal 730. The coupler may further include one or more insulators 740.

The first terminal 720 may be disposed proximate a first portion of the magnet 710 and the second terminal 730 disposed proximate a second portion of the magnet 710. In one implementation, the first and second terminals 720, 730 may have a cap type structure. The first terminal 720 may be disposed upon a first end (e.g., top) of the magnet 710 and extends partially down the side of the magnet 270. The second terminal 730 may be disposed upon a second end (e.g., bottom) and extends partially up the side of the magnet 710. The insulator 740 may be disposed between the magnet 710 and the first terminal 720 and/or the magnet 710 and the second terminal 730.

Figure 8A:
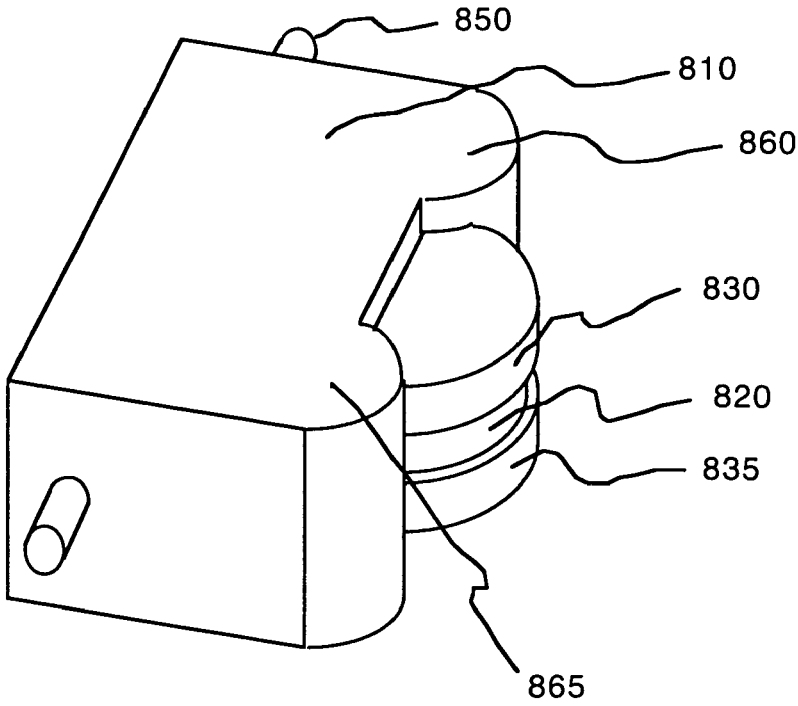
FIG. 8A shows a block diagram of a coupler, in accordance with another embodiment of the present invention.
Figure 8B:
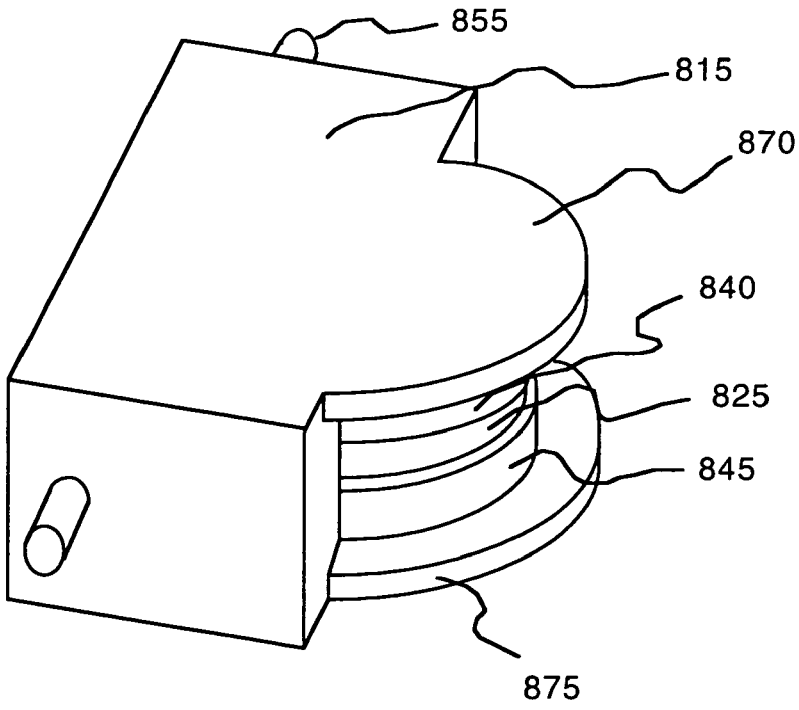
FIG. 8B shows a block diagram of a coupler, in accordance with another embodiment of the present invention.

In one embodiment, as depicted in FIGS. 8A and 8B, the coupler may further include a housing 810, 815. The housing may be adapted to fixedly contain the one or more magnets 820, 825 and plurality of terminals 830, 835, 840, 845 as an assembly. The housing 810, 815 may also contain one or more insulators and/or the housing 810, 815 itself may act as a insulator separating the terminals 830, 835, 840, 845 from each other and/or the magnet 820, 825. In one embodiment, the housing 810, 815 may include a pivot point 830, 835, such as oppositely disposed posts, a hitch ball or the like. The pivot point 830, 835 enables coupling of imprecisely aligned couplers (e.g., one coupler is higher than the other coupler). In another embodiment, the housing 810, 815 may include an alignment guide 860, 865, 870, 875. In one implementation, the alignment guides 860, 865, 870, 875 may be oppositely disposed on either side (e.g., laterally or vertically) of the coupler. The alignment guides are adapted to center the point of coupling proximate the center of the coupler. In one implementation, a first coupler includes lateral oppositely disposed alignment guides 860, 865 and a second coupler includes vertical oppositely disposed alignment guides 870, 875. Accordingly, the respective alignment guides 860, 865, 870, 875 combine to provide keying of the couplers in addition to enabling centering laterally and vertically.

Figure 11:
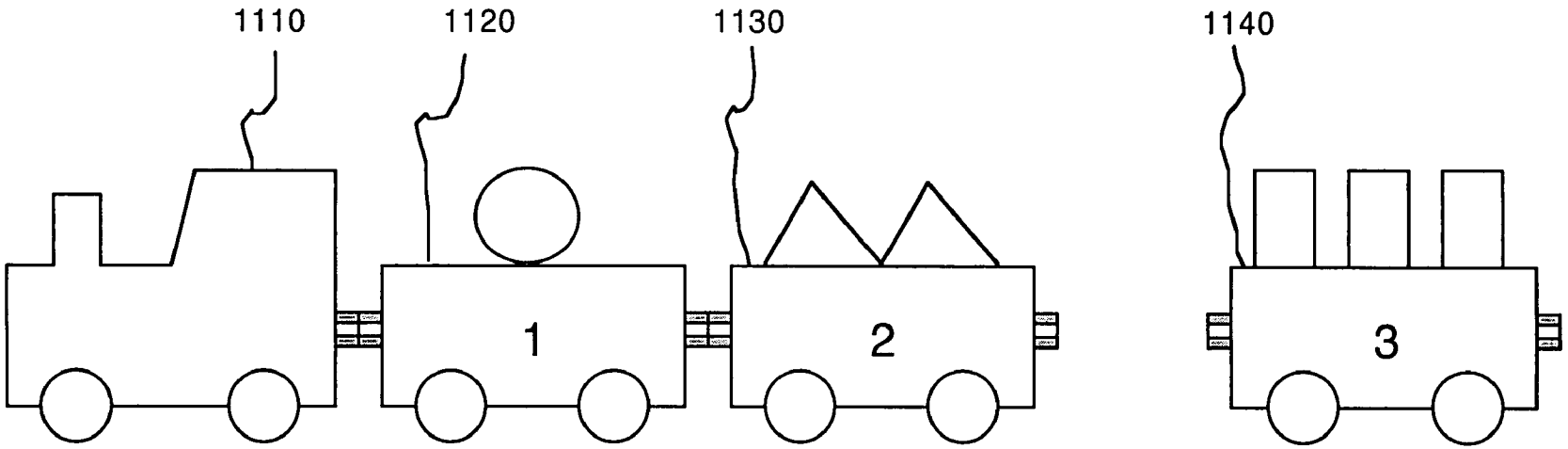
FIG. 11 shows a block diagram of a toy, in accordance with embodiments of the present invention.

Referring now to FIG. 11, a block diagram of a toy, in accordance with embodiments of the present invention, is shown. As depicted in FIG. 11, the toy includes a plurality of devices 1110, 1120, 1130, 1140 operable to be coupled in a chain. A first device 1110 may be a model train engine. The other devices 1120, 1130, 1140 may be model train cars each having on or more unique features, such as color, shape, unit number and the like. The shape of the train cars may also be adapted for stacking or nesting.

The train engine 1110 (e.g., head-end or control device) may include a body, a first coupler disposed on the rear of the body and a circuit module disposed within the body. The circuit module may include a processor and a test circuit having inputs and outputs. The processor may be operable to determine the presence of each of the train cars 1120, 1130, 1140 in the chain. The presence of each of the train cars 1120, 1130, 1140 may be determined, in response to one or more the train cars 1120, 1130, 1140 being coupled to the train engine 1110, by controlling the inputs of the test circuit and monitoring the output of the test circuit as described above. The circuit module may also include an identification device coupled to the processor for generating a signal identifying the particular device in response to the processor determining the presence thereof.

Each train car 1120, 1130, 1140 may include a body, a first coupler disposed on the front of the body, a second coupler disposed on the rear of the body and a circuit module disposed within the body. The circuit module of each train car 1120, 1130, 1140 may be operable to uniquely identify the car when the train car 1120, 1130, 1140 is coupled to the train engine 1110, or coupled to the train engine 1110 and one or more other train cars 1120, 1130, 1140. The circuit module of each train car 1120, 1130, 1140 may include one or more passive components as described above.

In one embodiment, upon determining the presence of a particular train car 1120, 1130, 1140 coupled to the train engine 1110, a feature of the particular train car may be audibly output. For example, the color of the train car, the number on the train car, a feature of the train car (e.g., one ball, two bells, etc.), or a tune may be output. Accordingly, the toy may advantageously teach a user concepts such as colors, numbers, shapes, tunes and/or the like.

Each coupler on the train engine 1110 and train cars 1120, 1130, 1140 may include a magnet and two terminals in a housing as described above. Such couplers may provide a mechanical coupling and an electrical coupling between one or more of the train cars 1120, 1130, 1140 and the train engine 1110.

In one embodiment, the magnetic mechanical coupling provided by the couplers may be readily operable by a user having limited motor skills, such as an infant. The magnetic mechanical coupling provided by the couplers and the stackable or nesting shape of the train cars 1120, 1130, 1140 may also advantageously enable a user to develop improved motor skills. The pivotal coupling provided by the couplers may also enable use of the toy on rough and/or uneven surfaces, such as carpets, blankets and the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A device for coupling to other devices, said device comprising:

a body of a model vehicle;

a first coupler disposed on a first side of said body and operable to electrically couple to a coupler of a first one of said other devices;

a second coupler disposed on a second side of said body and operable to electrically couple to a coupler of a second one of said other devices; and a circuit element coupled to said first and second couplers, said circuit element providing unique identification of said device from among said devices when said device is coupled to one or more of said other devices.

2. The device as described in claim 1, wherein said first coupler comprises:

a magnet operable to mechanically couple said device to one of said other devices;

a first terminal operable to electrically couple said circuit element to a first terminal of said one of said other devices; and a second terminal operable to electrically couple said circuit element to a second terminal of said one of said other devices.

3. The device as described in claim 1, wherein said model vehicle comprises a model train car, wherein said first side comprises a front side of said model train car, and wherein said second side comprises a rear side of said model train car.

4. The device as described in claim 1, wherein said circuit element provides electrical continuity between a first and second terminal of each of said first and second couplers, and wherein said electrical continuity is provided across each of said other devices when coupled in a chain.

5. The device as described in claim 1, wherein, when said device is coupled to one or more of said other devices, said circuit element is electrically coupled in parallel to circuit elements of said other devices coupled in a chain.

6. The device as described in claim 1, wherein said circuit element comprises only passive components.

7. The device as described in claim 1, wherein said circuit element is disposed within said body.

8. The device as described in claim 1, wherein:

said first coupler is also operable to mechanically couple with a coupler of said first one of said other devices when brought in proximity therewith; and said second coupler is also operable to mechanically couple with a coupler of said second one of said other device when brought in proximity therewith.

9. A device for recognizing other devices, said device comprising:

a body of a model vehicle;

a coupler disposed on said body and operable to couple to a coupler of one of said other devices;

a test circuit having inputs and outputs and coupled to said coupler;

a processor, coupled to said test circuit, operable to determine presence of a particular device within a chain of devices by controlling said inputs of said test circuit and monitoring said outputs of said test circuit and operable to determine said presence in response to said chain of devices being coupled to said coupler.

10. The device as described in claim 9, wherein:

said chain of devices comprises a plurality of devices mechanically coupled together;

each of said plurality of devices comprises a respective circuit element; and each of said respective circuit elements are electrically coupled together.

11. The device as described in claim 10, wherein said respective circuit elements of said chain of device are electrically coupled in parallel to each other.

12. The device as described in claim 10, wherein said processor determines said presence by:

applying voltages to said inputs of said test circuit;

monitoring an electrical response of said circuit elements of said chain of devices as reflected on said outputs of said test circuit; and based on said electrical response, determining if said particular device is present within said chain of devices.

13. The device as described in claim 9, wherein said comprises a model train car, and wherein said chain of devices comprise model train cars coupled together.

14. The device as described in claim 9, further comprising an identification device coupled to said processor for generating a signal identifying said particular device in response to said processor determining said presence thereof.

15. The device as described in claim 14, wherein said identification device is a speaker operable to render an audible identifier of said particular device in response to said processor determining said presence thereof.

16. The device as described in claim 9, wherein said coupler is operable to electrically couple and mechanically couple to one of said other devices.

17. The device as described in claim 16, wherein said coupler comprises:

a plurality of terminals for providing said electrical coupling; and a magnet for providing said mechanical coupling.

18. The device as described in claim 9, wherein said chain of devices comprises only said particular device.

19. A model vehicle coupler comprising:

a magnet for mechanically coupling a portion of said model vehicle coupler to at least one other model vehicle coupler, wherein a surface of said magnet is operable to contact said at least one other model vehicle coupler and perform said mechanical coupling;

a first terminal disposed proximate a first portion of said magnet; and a second terminal disposed proximate a second portion of said magnet and separated from said first terminal, and wherein said first terminal and said second terminals are operable to electrically couple to other terminals when mechanically coupled thereto by said magnet.

20. The coupler of claim 19, further comprising an insulator disposed between said magnet and said first terminal.

21. The coupler of claim 19, further comprising a housing containing said magnet, said first terminal and said second terminal.

22. The coupler of claim 21, wherein said housing comprises a pivot point.

23. The coupler of claim 21, wherein said housing comprises an alignment guide.

24. The coupler of claim 23, wherein said alignment guide is operable to provide keying of the coupler when coupling to another coupler.

25. The coupler of claim 19, further comprising a third terminal disposed proximate a third portion of said magnet between said first terminal and said second terminal, wherein said third terminal is biased outwardly from said magnet.

26. The coupler of claim 19, wherein said model vehicle coupler has an arched surface proximate a point of coupling when coupled to said other model vehicle coupler.

* * * * *